US006647849B2

(12) United States Patent
Jones

(10) Patent No.: US 6,647,849 B2
(45) **Date of Patent: *Nov. 18, 2003**

(54) DEVICE FOR VARYING A CYLINDER'S EFFECTIVE DIAMETER

(75) Inventor: Jackson Hacker Jones, Rochester, NH (US)

(73) Assignee: Heidelberger Druckmaschinen, Heidelberg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 68 days.

(21) Appl. No.: 09/124,907

(22) Filed: Jul. 30, 1998

(65) Prior Publication Data

US 2001/0047709 A1 Dec. 6, 2001

(51) Int. Cl.[7] ..... B26B 1/20; B26D 7/20

(52) U.S. Cl. ..... 83/698.42; 83/659; 83/347; 492/56

(58) Field of Search ..... 83/347, 346, 698.42, 83/659; 492/54, 56

(56) References Cited

U.S. PATENT DOCUMENTS

| | | | | | |
|---|---|---|---|---|---|
| 1,482,391 | A | | 2/1924 | English | |
| 1,618,191 | A | * | 2/1927 | Hemberger | 83/348 |
| 3,618,438 | A | * | 11/1971 | Simson | 425/363 |
| 3,739,675 | A | * | 6/1973 | Duckett et al. | 83/347 |
| 3,756,760 | A | * | 9/1973 | McBride | 83/37 |
| 3,871,777 | A | * | 3/1975 | Sauer | 83/659 |
| 3,882,750 | A | * | 5/1975 | Duckett et al. | 83/659 |
| 4,187,752 | A | * | 2/1980 | Chesnut | 83/698.42 |
| 4,856,400 | A | * | 8/1989 | Kelzer | 83/885 |
| 4,982,639 | A | * | 1/1991 | Kirkpatrick | 83/347 |
| 5,076,128 | A | * | 12/1991 | O'Connor et al. | 83/659 |
| 5,078,535 | A | * | 1/1992 | Kirkpatrick | 403/339 |
| 5,107,733 | A | * | 4/1992 | Pamatier et al. | 83/176 |
| 5,163,584 | A | * | 11/1992 | Huber et al. | 222/1 |
| 5,249,493 | A | * | 10/1993 | Breton | 83/154 |
| 5,297,461 | A | * | 3/1994 | Hirakawa et al. | 83/304 |
| 5,309,804 | A | * | 5/1994 | Norris et al. | 83/37 |
| 5,622,113 | A | | 4/1997 | Hansen | |
| 5,758,560 | A | * | 6/1998 | Fiscus | 83/698.42 |
| 5,916,346 | A | * | 6/1999 | Neal | 83/659 |

FOREIGN PATENT DOCUMENTS

| | | |
|---|---|---|
| DE | 198 52 439 A1 | 6/1999 |
| EP | 0 249 874 A | 12/1987 |
| EP | 0 523 346 A | 5/1992 |

* cited by examiner

*Primary Examiner*—Richard Chang
(74) *Attorney, Agent, or Firm*—Burns, Doane, Swecker & Mathis, LLP

(57) ABSTRACT

The present invention is related to a device for varying a cylinder's effective diameter. It includes a shell member being removably mounted on a surface of a cylinder. On the easy exchangeable shell member having a base plate an elastic material is provided allowing for a compressible surface gain.

19 Claims, 4 Drawing Sheets

DEVICE FOR VARYING A CYLINDER'S EFFECTIVE DIAMETER

FIELD OF THE INVENTION

The present invention is related to a device for varying a cylinder's effective diameter which for example can be arranged in a folding apparatus for processing a web of material.

BACKGROUND OF THE INVENTION

EP 0 249 874 discloses an improved stacking method and apparatus. With this device signatures are stacked into a plurality of bundles prior to further processing thereof. The signatures are conveyed to a stacker by an infeed conveyor. The stacker places counted stacks of signatures on a turn table from where the individual bundles are ejected by ejecting means after stacking. The infeed conveyor is operated at a selected speed. The stacker, the turn table, and the ejecting means are operated at a speed which is a function of the rate of speed of the signatures delivered by the infeed conveyor to the stacker. This solution comes along with a V-shaped roller surface to apply a V-shaped profile to stiffen the signatures to obtain advantageous handling characteristics.

EP 0 523 346 A1 is related to an apparatus for cutting and transporting a paper web in a folding apparatus of a printing press. The apparatus disclosed in this document comprises a pair of cutting cylinders for cutting web sections from the web and a transporting device for transporting the web sections away from the cutting cylinders. The first cutting cylinder has at least one cutting anvil and the second cutting cylinder has at least one cutting knife which meets the cutting anvil at a nip between the cutting cylinders to cut the web moving through the nip. A plurality of strips are supported on the first cutting cylinder and a plurality of strips are supported on the second cutting cylinder. The strips have positions on the cutting cylinders in which they impress a temporary reinforcing profile onto each newly formed leading portion of the web when the strips move through the nip. At least one smoothing surface is supported on the first cutting cylinder and at least one smoothing surface is supported on the second cutting cylinder. The smoothing surfaces have positions on the cutting cylinders wherein the smoothing surfaces remove the temporary reinforcing profile from the leading portion of the web on the smoothing surfaces move through the nip.

However, the solution according to EP 0 523 346 A1 discloses an adhesive bonding of said strips onto the respective cylinders surfaces which causes problems in replacing worn out strips on said cylinders surfaces.

The problem of changing the effective outer diameter of a cylinder has been addressed by gluing on Velcro brand hook and loop fastener sections on the cylinders surfaces, or mylar-coating to increase the respective cylinder diameter. Another approach was using air or foam cushions to squeeze the running web of material into other rotating rolls. Once these materials have been mounted on the respective cylinder surface, it is difficult to remove them from the cylinder surface as they are bonded onto those surfaces. Thus, the exchange of this materials comes along with the difficulty of dismounting the initially bonded materials after months of operation.

SUMMARY OF THE INVENTION

In view of the prior art cited and the problems encountered in the technical field, it is accordingly an object of the present invention to facilitate the change of a cylinders' effective diameter.

Another object of the present invention is to provide a quick interchange device to change a cylinder's gain according to the requirements.

A still further object of the present invention is to provide a surface jacket for a cylinder covered with a material having elastic properties creating a semi-compressible cylinder's surface.

According to the present invention, a device for varying the effective diameter of a cylinder comprises:

a shell member removably mounted on a surface of a cylinder, said shell member having a base plate and an elastic material arranged on said base plate allowing for a compressible surface gain.

This solution offers several advantages such as preserving a variety of surface shells, each having a coating with different material properties to allow for a strong squeeze of the web of material in the nip or a lower squeeze of the web of material in the respective nip. According to the thickness of the web of material to be processed, the thickness of the elastic material on the base plate can be chosen. Since the shell member is removably mounted on the cylinders surfaces, a quick interchange is feasible now, which according to the bonded material was not easy to achieve with the solutions already known in the field. In a folder apparatus where—among other applications—the present invention can be used different amounts of gain be adjusted—just as is required for the respective job. This is extremely important for newspaper applications and wherever there else is an extreme time pressure.

According to further details of the present invention, said cylinders include lock-up devices for the shell members respective trailing edge. Furthermore, said cylinders are equipped with a quick mounting device for the respective shell members'leading edge. Said quick mounting device may be embodied by a hook-shaped edge of the part of the cylinder forming the wall of a gap in which said lock-up device is arranged. Preferably the width of said base plate in lateral direction thereof corresponds to the width of a printing plate suitable for newspaper applications. The width of said shell member is approximately 16.00 inches. The base plate may be manufactured of aluminium or steel having a higher degree of durability.

By means of the aforementioned lock-up device for the removable shell member said shell members are quickly removable from respective cylinders surface. Thus, on the respective base plate of said shell members different coatings having different elastic properties may be applied. For each job the required shell members easily are chosen, dismounted and mounted on the cylinder, respectively. The elastic material applied as a coating of uniform or varying thickness on the respective base plate may be sprayed foam or a hook and loop fastener material such as Velcro. A coating of a reinforced rubber material is conceivable as well. The elastic material may be made of a duro-elastic material or an abrasive cloth.

Said elastic material may be applied to the base plate so as to fully cover the entire surface thereof. Said elastic coating can be arranged in strips as well so as to form recesses there between, where there is no elastic material.

Said lock-up device for the shell members may be arranged within a gap on the circumference of said cylinders and comprise a tensioning member for said trailing edge of said shell member. The tensioning member is arranged so as to be pivotable about an axis.

Said shell members being quickly mounted and dismounted on or from a cylinders body, respectively, may be arranged on cylinders or pairs of cylinders cooperating with each other. Said cylinders may form a part of a folder apparatus design.

BRIEF DESCRIPTION OF THE DRAWINGS

The novel features which are considered as characteristic for the invention are set forth in particular in the appended claims. The invention itself, however, both as to its construction and its method of operation together with additional objects and advantages thereof, will be best understood from the following description of a specific embodiment when read in connection with the accompanying drawings, in which:

DESCRIPTION OF PREFERRED EMBODIMENTS

Figure 1:
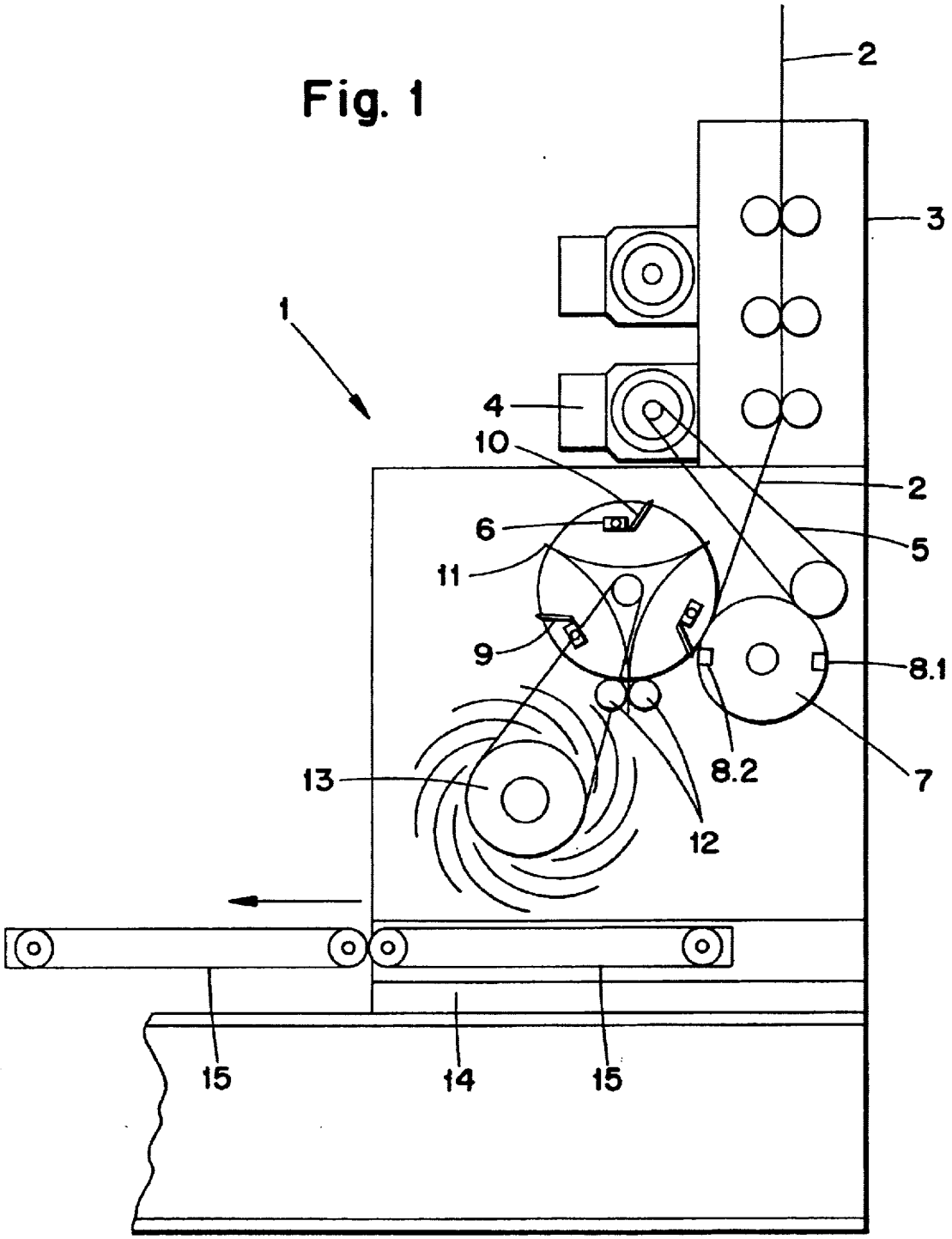
FIG. 1 shows a side elevation of a folder apparatus, including a 2-knife-cutting cylinder assigned to a 3-blade-folding cylinder.

FIG. 1 shows a side elevation of a folder apparatus including a 2-knife-cutting cylinder assigned to a 3-blade-folding cylinder.

A folder apparatus 1 processing a web of material 2 such as a printed web may be arranged below a turner bar arrangement of a rotary printing press. Said web 2 enters the folder apparatus 1 via a nip module 3, in which several nip roll arrangements are provided. On top of the folder's 1 housing a drive 4 is placed which may transmit its driving momentum via a belt 5 as shown in FIG. 1. Said drive 4 even could drive the folder directly without the implementation of a transmission element such as a belt or the like. Notwithstanding the configuration according to FIG. 1 the folder's cylinders maybe driven via direct drives, or the nip roll arrangements may be driven via direct drives. The folder shown in FIG. 1 is a 3:2 folder but not restricted to a 3:2 design, a 2:1 design with regard to the respective cylinder diameters as well is conceivable. Below said drive 4 in the housing of the folder 1 a folding cylinder 6 is arranged, having three folding blades arranged on its circumference. Said folding cylinder 6 cooperates with a two-knife-cutting cylinder 7, having arranged two-knife assemblies 8.1, 8.2 respectively, on its circumference. On the folding cylinder 6 three folding blades are arranged, 120° offset to one another, furthermore, three anvil bars 9 and three sets of signature pinning elements 10. Said anvil bars 9 and said pin elements 10 are arranged in groups on the circumference of said folding cylinder 6, said groups being arranged 120° offset with respect to one another. The two-knife cylinder 7 is placed with respect to the three-blade folding cylinder 6 that both cylinders rotate in face to one another, i.e. said knife-assemblies 8.1 and 8.2 respectively cooperate with said anvil bars 9 on the circumference of said folding cylinder 6. Thus, signatures are severed in the nip between said cylinders 6 and 7 respectively and seized upon the circumference of said folding cylinder 6 by means of the signatures pin elements 10 assigned thereto. Below said folding cylinder 6 a fold roll assembly 12 is arranged in the nip in which said blades push the respective signatures. After that said signature pin elements 10 have released the respective signature's front edge. Thus, the signatures severed from said web 2 are folded prior of being pushed into the respective fan pockets of a fan wheel 13 rotatably arranged below said fold roll assembly 12. In this context said cylinders 6, 7 are suitable for newspaper applications but not restricted thereto.

The signatures being received by the various fan pockets of the fan wheel 13 are delivered and on a conveyor 15 conveying a shingled formation of signatures for further processing such as trimming thereof.

Figure 2:
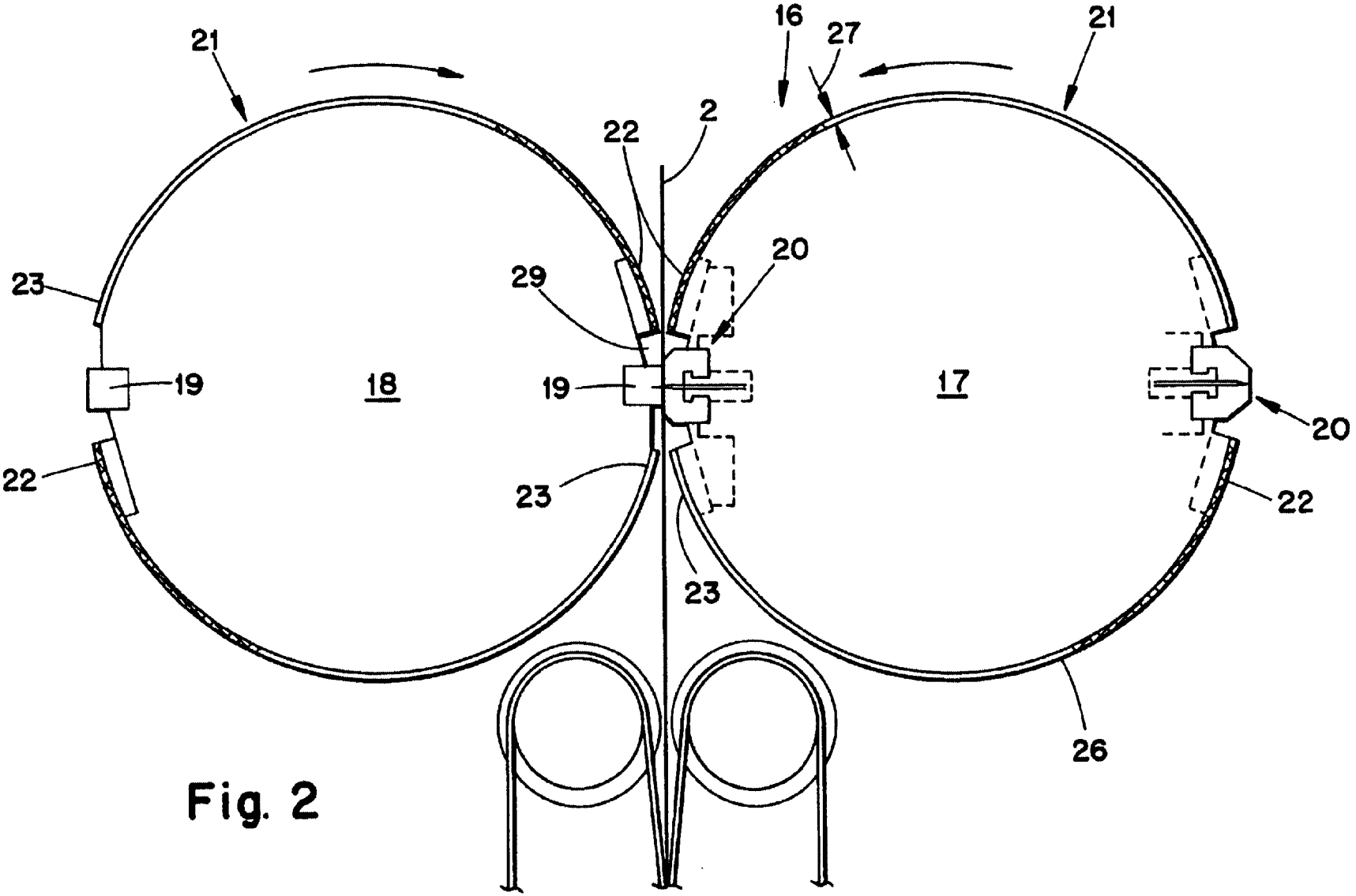
FIG. 2 shows a pair of cooperating cutting cylinders to which the invention may be applied likewise with transport arrangements arranged after the cutting nip.

FIG. 2 depicts a pair of cooperating cutting cylinders to which the invention may be applied likewise with transport arrangements located behind the cutting nip.

This schematically drawing shows two cooperating cutting cylinders 17, 18 respectively, both having the same diameter.

A web of material 2 in this embodiment is cut between an anvil cylinder 18 having two anvil bars 19 arranged on a circumference and a cutting cylinder 17 having two knife-assemblies 20 arranged on the respective circumference; shell members 21 covering the surface of said cylinders 17, 18 half-around arranged on the respective surfaces of both cylinders 17, 18 respectively. Said cylinders 17, 18 given in this drawing are a pair of cutting cylinders for commercial and/or publication applications. The interchangeable surface members 21 thus can be applied to cylinders for newspaper applications (see FIG. 1 cylinders 6, 7) or in publication or commercial applications as shown in FIG. 2. Said knife-assemblies 20 are given schematically only in this embodiment. Said knife-assemblies 20 arranged on the circumference of said cutting cylinder 14 cooperate with said anvil bars 19 arranged on the surface of said anvil cylinder 18. In this configuration a web of material 2 is squeezed between the elastic coating 26 attached on the base plates 24 of the respective shell members 21. The leading edge 22 and the trailing edge 23 of the shell member 21 are removably mounted on the cylinder surfaces given in greater detail in FIGS. 3 and 5.

By having applied a shell member 21 on the surfaces of the pair of cylinders 17, 18, a gain can be obtained to forward the signatures severed from the web of material 2 by forwarding them into conveying tape devices arranged behind the pair of cutting cylinders. As compared to the thickness of the elastic coating 26, the thickness 27 thereof may be somewhat lower as compared to the thickness of the elastic coating 26 on the shell member 21 given according to FIG. 3.

Figure 3:
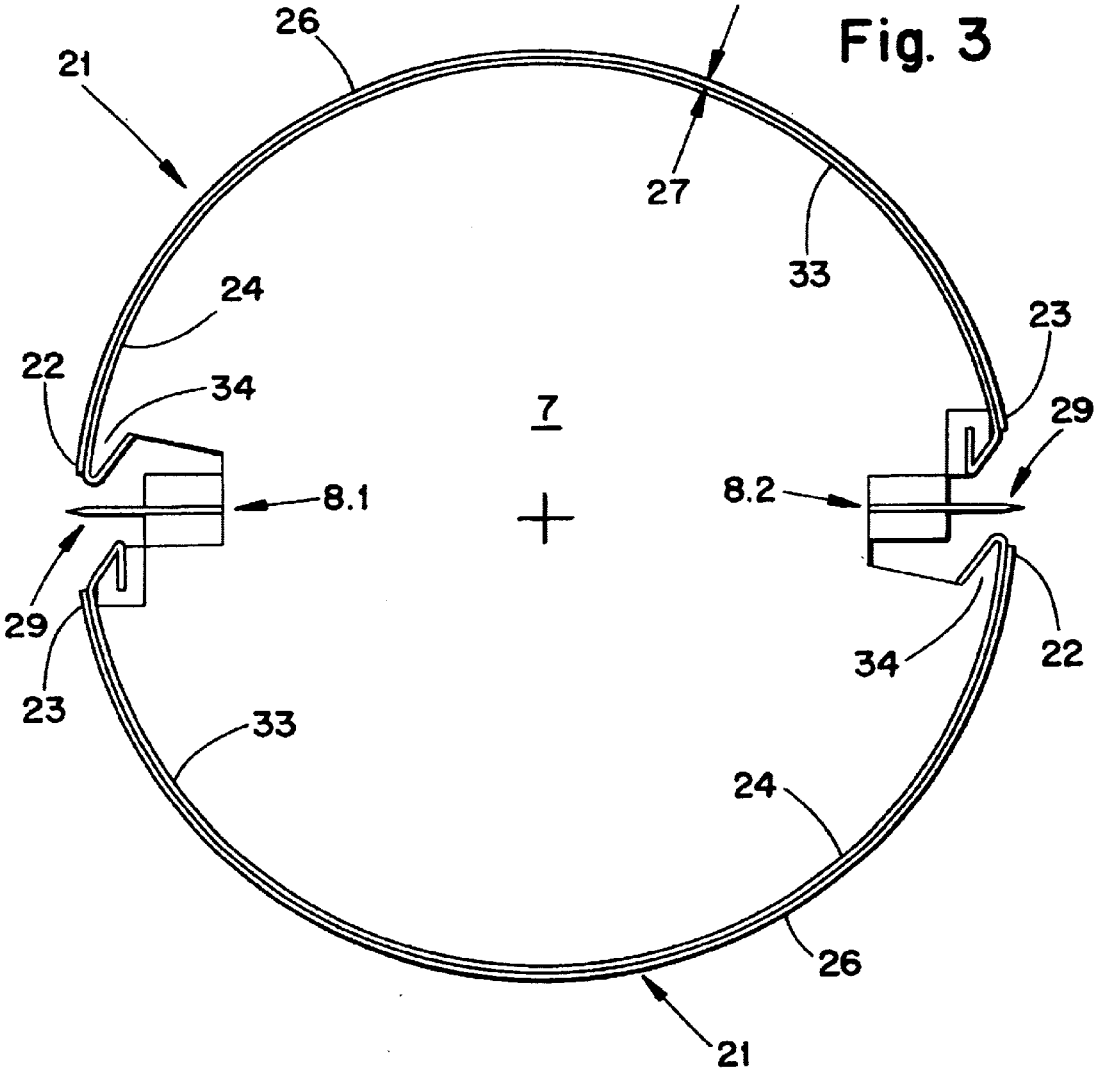
FIG. 3 shows a cutting cylinder having a surface member assigned thereto, FIG. 4 a top view of a surface member having an elastic coating on a base plate.

FIG. 3 shows a cutting cylinder having a surface member assigned thereto.

In this configuration a two-knife cutting cylinder 7 is given, which is apt to cooperate with a three-blade folding cylinder 6 as already given in FIG. 3 of the present application. Said two-knife cutting cylinder 7 comprises two knife assemblies 8.1, 8.2 respectively, each arranged within a gap 29 extending over the entire width of said cutting cylinder 7 respectively. Said shell members 21 comprises an angled surface portions of the base plate 24 in the lead edge section 22. Said angled surface portions are mounted on a hook-shaped fastening 34 formed on one side of a respective wall of the gap 29 in which said knife-assemblies 8.1, 8.2 respectively are mounted. This configuration allows for a quick mounting and dismounting of the lead edge portion 22 of the shell member 21 according to the present invention. The respective trailing edge 23 of the shell member 21 is being clamped in a lock-up device 28 shown in greater detail in the accompanying FIG. 5. The shell member 21 comprises a base plate 24 arranged on the surface 33 of the cylinder 7. Said base plate 24 is provided with a coating 26 having a thickness 27 which may depend upon what material is used as a coating 26.

Materials conceived are a sprayed foam, a hook and loop fastener such as Velcro, a sponged rubber, abrasive cloth or a reinforced rubber structure, adhesivlely bonded onto said base plate 24 or a mylar material. By cooperation of this shell member 21 or a jacket, a gain can be obtained which allows the signatures severed from the web of material 2 to be folded much more easier between said fold rolls 12 arranged below the three-blade folding cylinder 6 mentioned previously. By means of the elastic properties of the elastic coating, the gain which can be achieved is dependent upon the thickness of the signatures, thus self-compensating. After retraction of the pin elements 10 arranged on said three-blade folding cylinder 6, the gain obtained allows for easier folding of the signatures arranged on the circumference of said three-blade folding cylinder 6. On the circumference of said cutting cylinder 7 given in FIG. 3 two half-around extending shell members 21 are arranged securing that the signature severed from the web of material 2 each obtain the required gain to allow for easier fold-off of said signatures. For reasons of clarifications said lock-up devices 28 for the respective shell members 21 trailing edges 23 are not given in further details in FIG. 3. In this figure said knife assemblies 8.1, 8.2 respectively, are mounted in said gaps 29 previously mentioned, the respective lock-up device 28 being arranged in said gap 29 as well as shown in FIG. 5 of the present application.

Figure 4:
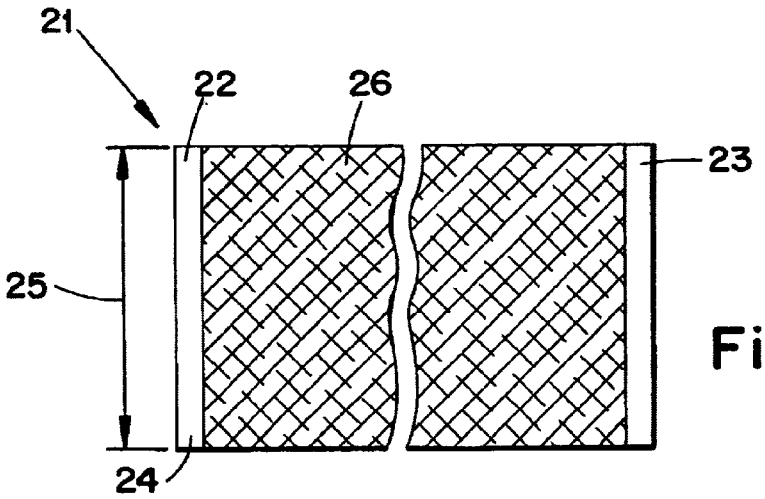

FIG. 4 shows a plan view of a shell member 21 according to the present invention.

In the embodiment according to FIG. 4, the base plate 24 of the shell member 21 is covered with an elastic coating 26 fully covering the base plate 24. It is conceivable as well to have the elastic coating 26 arranged in a strip wise arrangement on the surface of said base plate 24. In this case, said coating sections extend along the surface of the base plate 24 so as to form recesses there between, having likewise a strip like-shape, but would of course not contact the web of material 2. The base plate 24 may have a thickness of 0.012 inches, i.e. 0,3 mm approximately. With said shell members 21 variable cut-off length of 21.50, 22.047 or 22.776 inches can be realised according to the productions requirements. Thus, said shell member 21 can be used as a cylinder surface compensating jacket, which allows to adjust the cutting cylinders effective outer diameter according to the requirements, i.e. different cut-off lengths which may occur on newspaper production. By having a number member of shell members 21 readily available, the respective cutting cylinders can be prepared so as to realise cut-off lengths without changing entire cylinders. By using the solution according to the present invention the problem is resolved by merely interchanging a shell member 21 applied on a respective cylinder surface. This can be achieved very quickly due to the lock-up devices assigned to the respective cutting cylinder, given in greater detail in FIG. 5.

Figure 5:
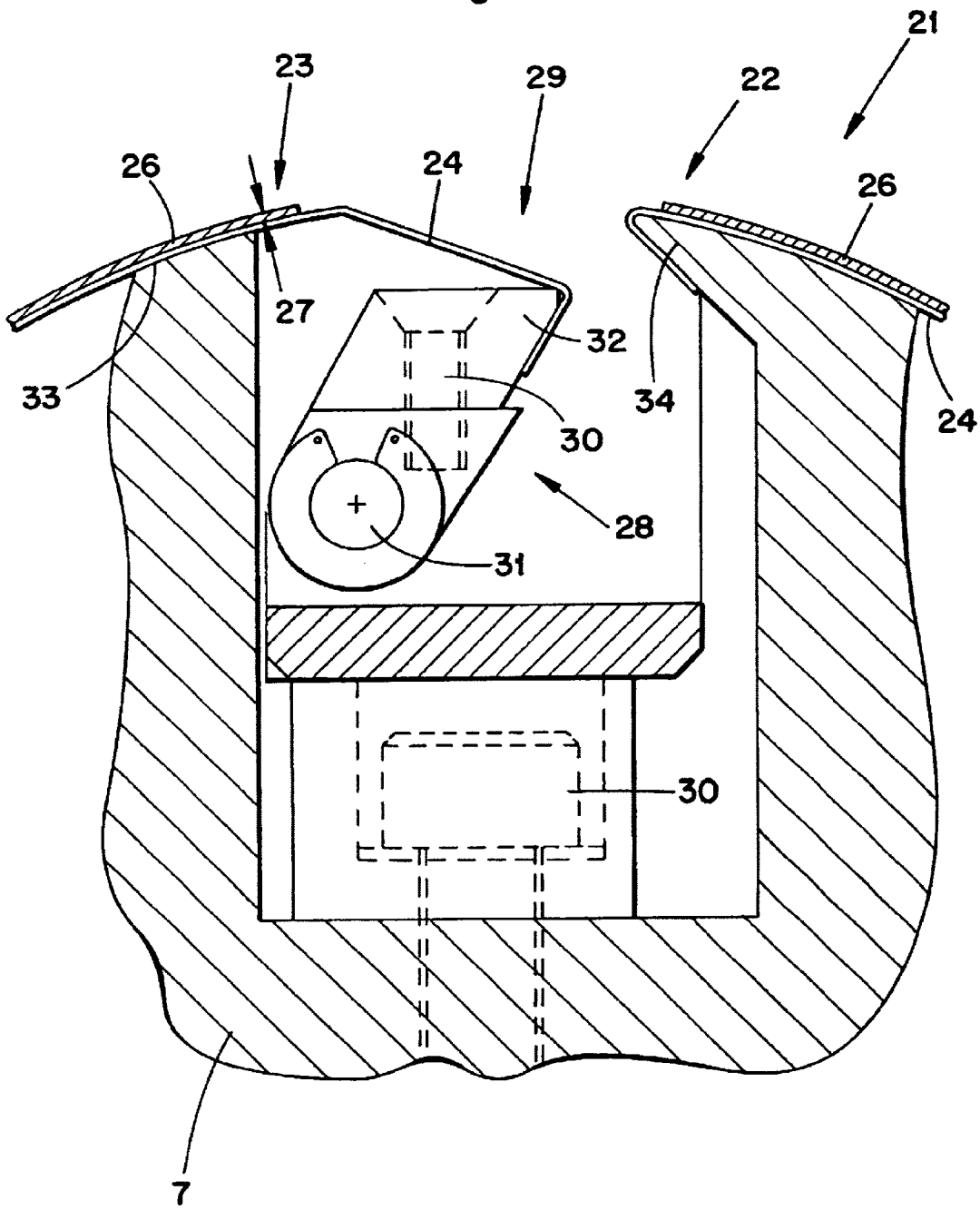
FIG. 5 shows a gap in the cutting cylinder's surface in which the lock-up device for the surface member trailing edge is provided.

FIG. 5 shows a respective gap in the cutting cylinder surface in which the lock-up device for the surface members trailing edge is provided.

Said surface member 21 comprises an angled portion at its respective lead edge 22, being in a hook-shape and quick clamped about a hock-shaped fastening 34. As already mentioned, said surface member 21 includes a base plate 24 of aluminum or steel, which is covered with an elastic coating 26. Said coating either is a foam, a sponged rubber, a velcro material or mylar. The respective trailing edge 23 of said shell member 21 is clamped in a lock-up device 28 having a tensioning member 32. Said tensioning member 32 is secured on a base which pivots about an axis 31 being spring loaded or having another biasing member attached thereto. The surface members 21 trailing edge 23 is secured in a gap 29 of said cutting cylinder 7. By releasing the lock-up device 28, said surface member 21 can be quickly interchanged. In FIG. 5 the trailing edge 23 of a half-around-shaped surface member 21 is shown, covering one half of the surface of a cutting cylinder 7. In said respective gap 29 the lead edge 22 of another surface number 21 is shown, as the cylinder 7 shown here is of a two-knife configuration, the respective lock-up device 28 and the hook-shaped fastening 34 is arranged opposite said gap 29 to receive the respective other edges 22, 23 of said surface member 21.

What is claimed is:

1. Device for varying an effective diameter of the cylinder comprising:

a shell member removably mounted on a surface of the cylinder;

said shell member having a base plate, a leading edge, a trailing edge, and an elastic material arranged on said base plate allowing for a compressible surface gain; and a lock-up device, secured in a gap of said cylinder, for securing the trailing edge, including a tensioning member secured on a base, which base pivots about an axis;

wherein the leading edge and trailing edge are positioned in such a manner providing a gap therebetween; and wherein the base is biased to pivot about the axis in such a manner that the tensioning member provides tension in at least a direction tangential to the cylinder.

2. The device according to claim 1, wherein said cylinder comprises a quick mounting device for the leading edge, wherein said base plate includes a fastening device operable to attach said leading edge to said cylinder.

3. The device according to claim 1, wherein a width of said base plate in a lateral direction approximately corresponds to a width of a printing plate suitable for newspaper applications.

4. The device according to claim 3, wherein the width of said base plate in said lateral direction is approximately 16.00 inches.

5. The device according to claim 1, wherein said base plate is made of aluminum.

6. The device according to claim 1, wherein said base plate is made of steel.

7. The device according to claim 1, wherein said elastic material is a sprayed foam.

8. The device according to claim 1, wherein said elastic material is a hook and loop fastener material.

9. The device according to claim 1, wherein said elastic material is a reinforced rubber material.

10. The device according to claim 1, wherein said elastic material is a duro-elastic material.

11. The device according to claim 1, wherein said elastic material is an abrasive cloth.

12. The device according to claim 1, wherein said elastic material is applied over an entire surface of said base plate.

13. The device according to claim 1, wherein the elastic material is applied in strips forming recesses therebetween along a width of said base.

14. Cutting cylinder comprising:

a shell member removably mounted on a surface of the cylinder;

said shell member having a base plate, a leading edge, a trailing edge, and an elastic material arranged on said base plate allowing for a compressible surface gain; and a lock-up device, secured in a gap of said cylinder, for securing the trailing edge, including a tensioning member secured on a base, which base is biased to pivot about an axis;

wherein the leading edge is secured to the surface of the cylinder;

wherein the leading edge and trailing edge are positioned in such a manner providing a gap therebetween; and wherein the tensioning member secures the trailing edge by providing force in at least a direction tangential to the cylinder.

15. Cutting cylinder pair comprising:

a shell member removably mounted on a surface of the cylinder said shell member having a base plate, a leading edge, a trailing edge, and an elastic material arranged on said base plate allowing for a compressible surface gain; and a lock-up device, secured in a gap of said cylinder, for securing the trailing edge, including a tensioning member secured on a base, which base is biased to pivot about an axis;

wherein the leading edge is secured to the surface of the cylinder;

wherein the leading edge and trailing edge are positioned in such a manner providing a gap therebetween; and wherein the tensioning member secures the trailing edge by providing force in at least a direction tangential to the cylinder.

16. Folder including a cylinder having a device for varying an effective diameter comprising:

a shell member removably mounted on a surface of the cylinder;

said shell member having a base plate, a leading edge, a trailing edge, and an elastic material arranged on said base plate allowing for a compressible surface gain; and a lock-up device, secured in a gap of said cylinder, for securing the trailing edge, including a tensioning member secured on a base, which base is biased to pivot about an axis;

wherein the leading edge is secured to the surface of the cylinder;

wherein the leading edge and trailing edge are positioned in such a manner providing a gap therebetween; and wherein the tensioning member secures the trailing edge by providing force in at least a direction tangential to the cylinder.

17. The cutting cylinder of claim 14, wherein said cylinder comprises a quick mounting device for securing the shell member's leading edge, said base plate including a hook-shaped fastening device operable to attach said shell member's leading edge to said cylinder.

18. The cutting cylinder pair of claim 15, wherein said cylinder comprises a quick mounting device for securing the shell member's leading edge, said base plate including a hook-shaped fastening device operable to attach said shell member's leading edge to said cylinder.

19. The cylinder of claim 16, wherein said cylinder comprises a quick mounting device for the shell member's leading edge, said base plate including a hook-shaped fastening device operable to attach said shell member's leading edge to said cylinder.

* * * * *